US011680438B2

(12) United States Patent
Fontijn et al.

(10) Patent No.: US 11,680,438 B2
(45) Date of Patent: Jun. 20, 2023

(54) ADJUSTABLE HEADER FOR SLIDING DOORS AND WINDOWS

(71) Applicant: GOLDBRECHT LLC, Culver City, CA (US)

(72) Inventors: Marcel Fontijn, Culver City, CA (US); Joshua Steven Ray, Los Angeles, CA (US)

(73) Assignee: GOLDBRECHT LLC, Culver City, CA (US)

( * ) Notice: Subject to any disclaimer, the term of this patent is extended or adjusted under 35 U.S.C. 154(b) by 0 days.

(21) Appl. No.: 15/735,760

(22) PCT Filed: May 24, 2017

(86) PCT No.: PCT/US2017/034166
§ 371 (c)(1),
(2) Date: Dec. 12, 2017

(87) PCT Pub. No.: WO2017/205461
PCT Pub. Date: Nov. 30, 2017

(65) Prior Publication Data

US 2018/0179804 A1 Jun. 28, 2018

Related U.S. Application Data

(60) Provisional application No. 62/342,369, filed on May 27, 2016.

(51) Int. Cl.
*E06B 1/52* (2006.01)
*E05D 15/06* (2006.01)
(Continued)

(52) U.S. Cl.
CPC ..... *E06B 1/52* (2013.01); *E05D 15/0652* (2013.01); *E05D 15/0686* (2013.01); *E06B 1/32* (2013.01); *E05Y 2600/10* (2013.01); *E05Y 2600/528* (2013.01); *E05Y 2600/628* (2013.01); *E05Y 2800/205* (2013.01); *E05Y 2800/37* (2013.01); *E05Y 2900/132* (2013.01);
(Continued)

(58) Field of Classification Search
CPC ..... E06B 1/52; E06B 1/32; E06B 3/26347; E06B 1/325; E06B 1/18; E06B 3/4636; E05D 15/0652; E05D 15/0686; E05Y 2800/37; E05Y 2800/205; E05Y 2600/628; E05Y 2600/528; E05Y 2600/10; E05Y 2900/132; E05Y 2900/148
See application file for complete search history.

(56) References Cited

U.S. PATENT DOCUMENTS 2,093,708 A * 9/1937 Breuer ..... A47H 1/06 16/95 D
3,120,683 A 2/1964 Harris
(Continued)

OTHER PUBLICATIONS

Written Opinion of the International Searching Authority of PCT/US2017/034166 dated Aug. 4, 2017.
(Continued)

*Primary Examiner* — Brian D Mattei
*Assistant Examiner* — Omar F Hijaz
(74) *Attorney, Agent, or Firm* — Sughrue Mion, PLLC

(57) ABSTRACT

An adjustable header having a first header piece and a second header piece, which are attachable to each other by a connector.

11 Claims, 8 Drawing Sheets

(51) Int. Cl.

| | |
|---|---|
| ***E06B 1/32*** | (2006.01) |
| ***E06B 3/263*** | (2006.01) |
| ***E06B 1/18*** | (2006.01) |
| ***E06B 3/46*** | (2006.01) |

(52) U.S. Cl.
CPC ..... *E05Y 2900/148* (2013.01); *E06B 1/18* (2013.01); *E06B 1/325* (2013.01); *E06B 3/26347* (2013.01); *E06B 3/4636* (2013.01)

(56) References Cited

U.S. PATENT DOCUMENTS 3,296,744 A 1/1967 Hentzi
4,151,682 A * 5/1979 Schmidt ..... E06B 3/26347 49/404
4,192,100 A * 3/1980 Klema ..... E05D 15/08 49/125
4,257,202 A * 3/1981 Biro ..... E06B 3/26347 52/204.51
5,109,910 A * 5/1992 Tortorella ..... A47H 15/04 160/197
6,668,500 B1 * 12/2003 Lamberts ..... E06B 3/26343 49/504
7,174,944 B1 2/2007 Clark et al.
8,579,006 B2 * 11/2013 Levin ..... E04B 2/827 160/184
9,631,409 B2 * 4/2017 Wang ..... E05D 15/0652
2005/0235571 A1 * 10/2005 Ewing ..... E05C 7/06 49/410
2006/0096192 A1 5/2006 Daudet
2008/0245027 A1 * 10/2008 Lambertini ..... E06B 3/26347 52/717.02
2011/0197515 A1 * 8/2011 Joray ..... E05D 15/0665 49/425
2013/0042534 A1 * 2/2013 Polus ..... E05D 15/0673 49/425
2013/0340363 A1 * 12/2013 Kim ..... E05D 15/0686 52/204.7
2014/0053488 A1 * 2/2014 Lenox ..... E06B 3/26303 52/404.1
2015/0052819 A1 * 2/2015 Lee ..... E06B 3/4627 49/420
2015/0121764 A1 * 5/2015 Lee ..... E05D 15/0686 49/420
2015/0247358 A1 * 9/2015 Kim ..... E05B 63/0056 49/406
2015/0354258 A1 * 12/2015 Geysels ..... E04F 21/0023 49/425

OTHER PUBLICATIONS

International Search Report of PCT/US2017/034166 dated Aug. 4, 2017.

* cited by examiner

ADJUSTABLE HEADER FOR SLIDING DOORS AND WINDOWS

CROSS-REFERENCE TO RELATED PATENT APPLICATION

This application claims the benefit of U.S. Provisional Application No. 62/342,369, filed May 27, 2016, in the United States Patent and Trademark Office, the disclosure of which is incorporated herein by reference in its entirety.

BACKGROUND

1. Field

Exemplary embodiments relate to sliding doors and windows, and more particularly, to a header used with sliding doors and windows, the size of which can be adjusted according to a number of tracks necessary for use with the header.

2. Description of the Related Art

Conventional headers for sliding doors and windows allow top-hung units to be suspended from the header or are used as a guide for floor supported units. The conventional headers are constructed using stock rectangular bars with ninety-degree angle extrusions.

Conventional headers, however, suffer from several deficiencies, including difficulty of customizing the header according to a change in the number of sliding panels and the headers suffer from poor thermal efficiency.

Exemplary embodiments overcome these shortcomings and solve the problems associated with the prior headers that have been constructed. The exemplary embodiments provide improved thermal efficiency and allow for easy customization of the header.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

The present inventive concept may allow various kinds of change or modification and various changes in form, and specific exemplary embodiments will be illustrated in drawings and described in detail in the specification. However, it should be understood that the specific exemplary embodiments do not limit the present inventive concept to a specific disclosing form but include every modified, equivalent, or replaced one within the spirit and technical scope of the present inventive concept. In the following description, well-known functions or constructions are not described in detail since they would obscure the invention with unnecessary detail.

The terminology used in the application is used only to describe specific exemplary embodiments and does not have any intention to limit the present inventive concept. Although general terms as currently widely used as possible are selected as the terms used in the present inventive concept while taking functions in the present inventive concept into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the invention. Accordingly, the terms used in the present inventive concept should be defined not by simple names of the terms but by the meaning of the terms and the content over the present inventive concept.

Figure 2:
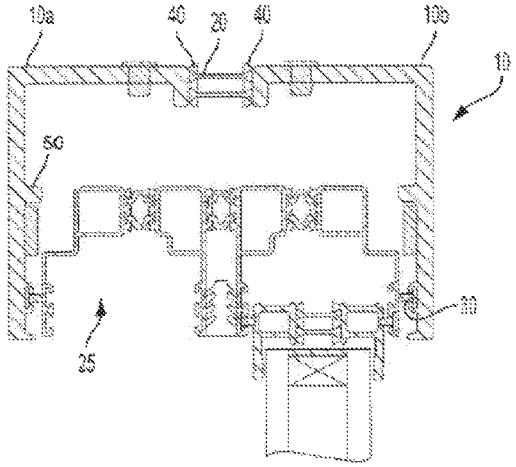
FIGS. 2 and 3 illustrate a cross-section view of headers according to a exemplary embodiment.
Figure 3:
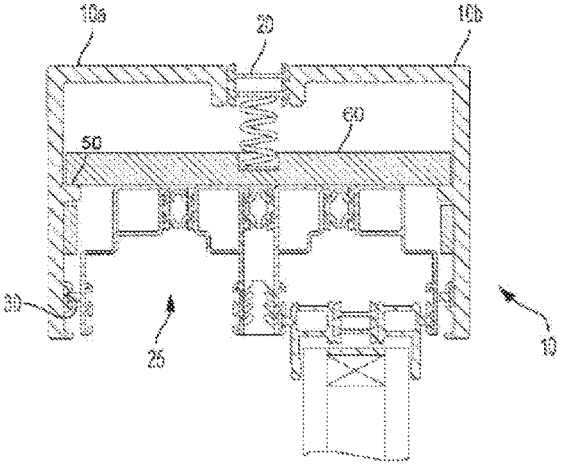
Figure 5:
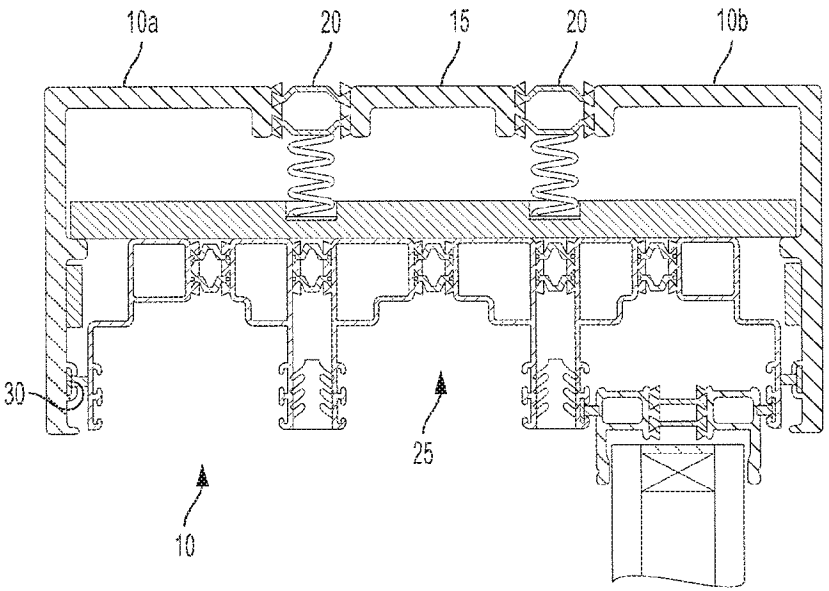
FIGS. 4 and 5 illustrate a cross-section view of headers according to another exemplary embodiment.
Figure 4:
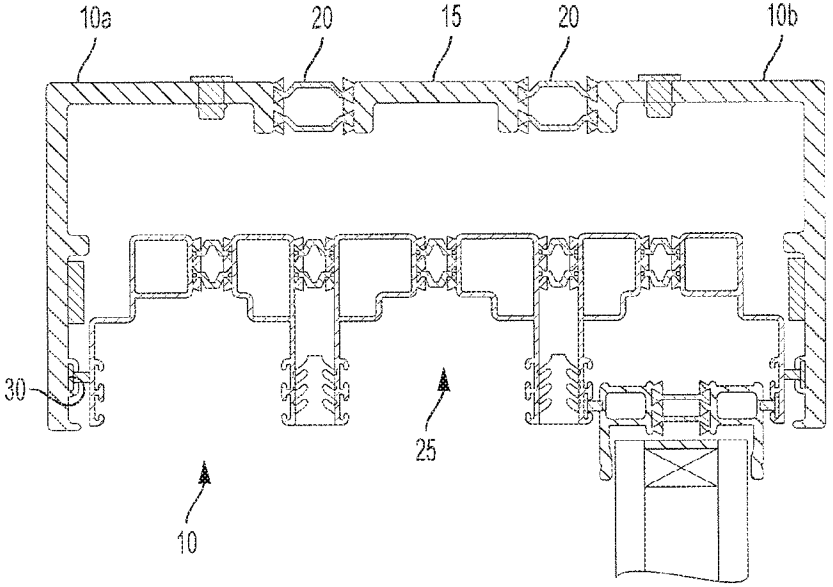
Figure 7:
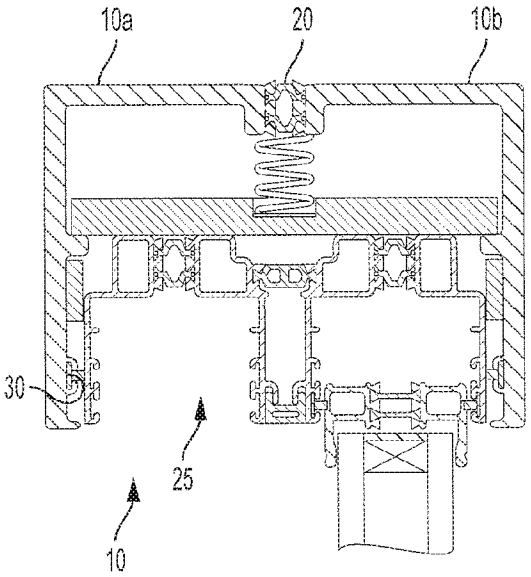
FIGS. 6-14 illustrate a cross-section view of headers according to exemplary embodiments.
Figure 6:
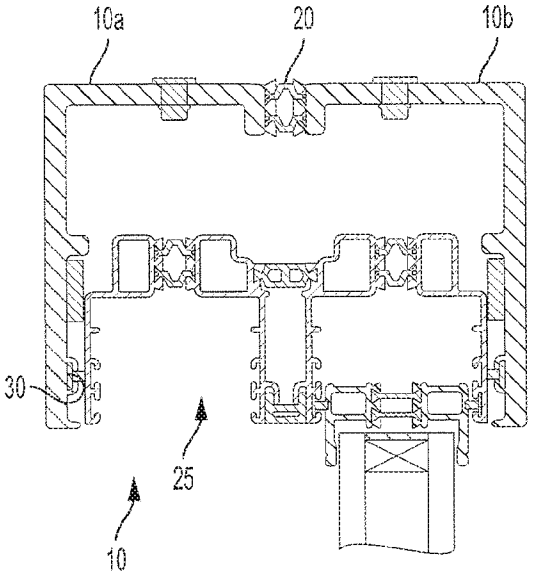
Figure 9:
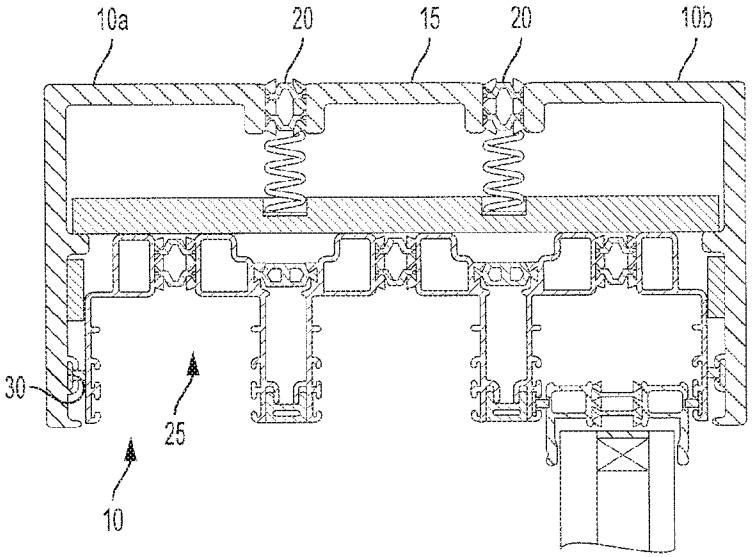
Figure 8:
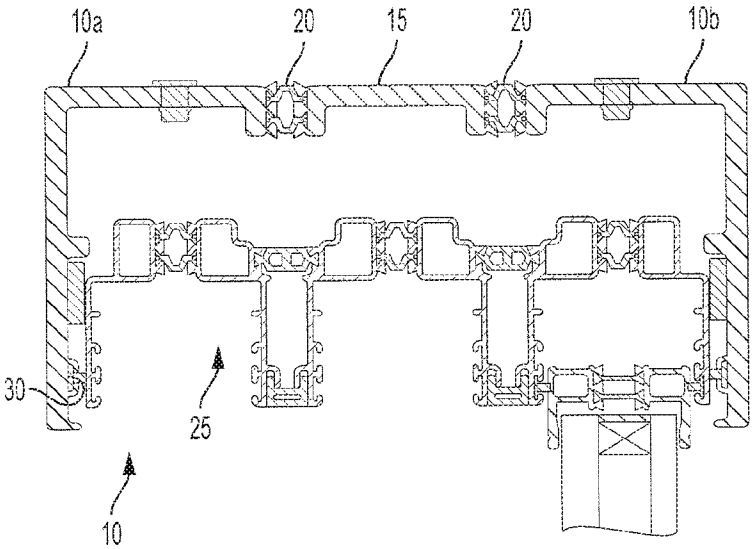
Figure 11:
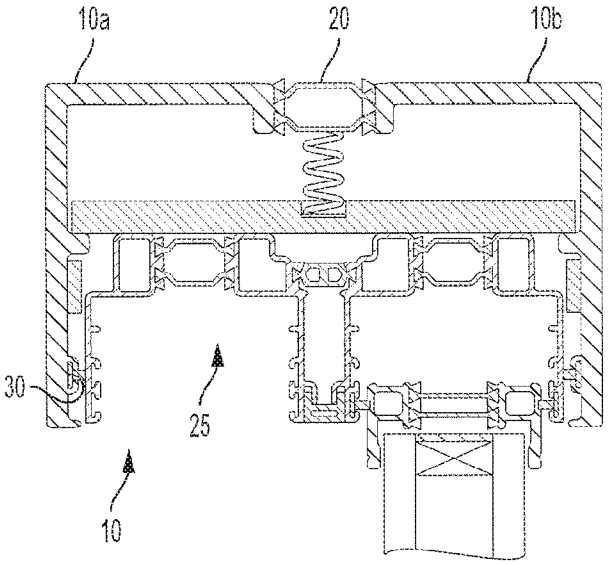
Figure 10:
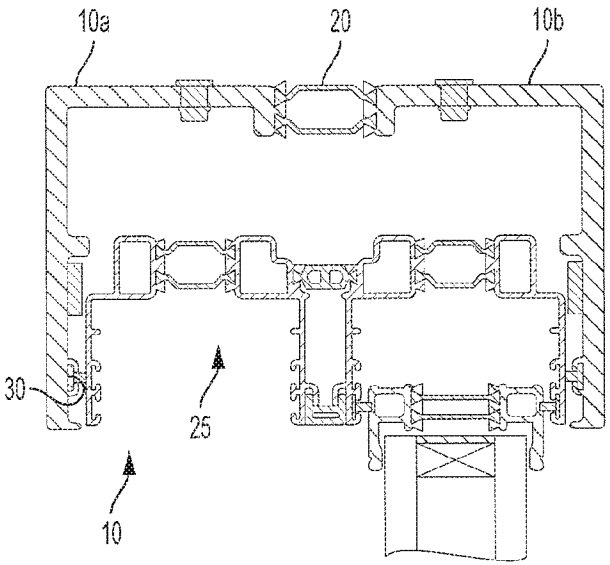
Figure 13:
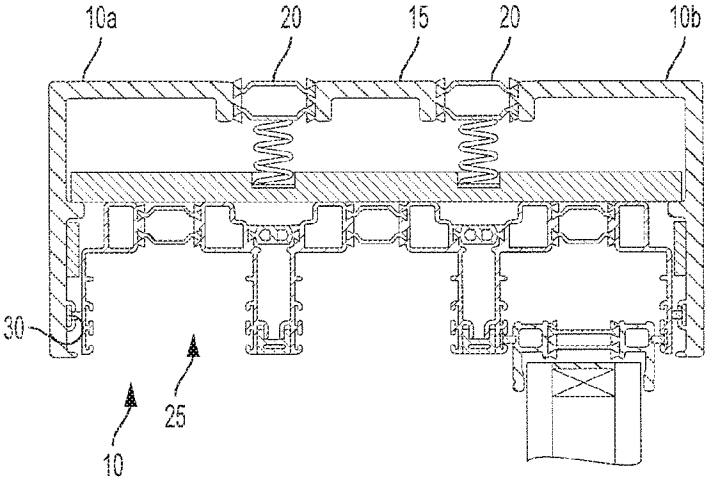
Figure 12:
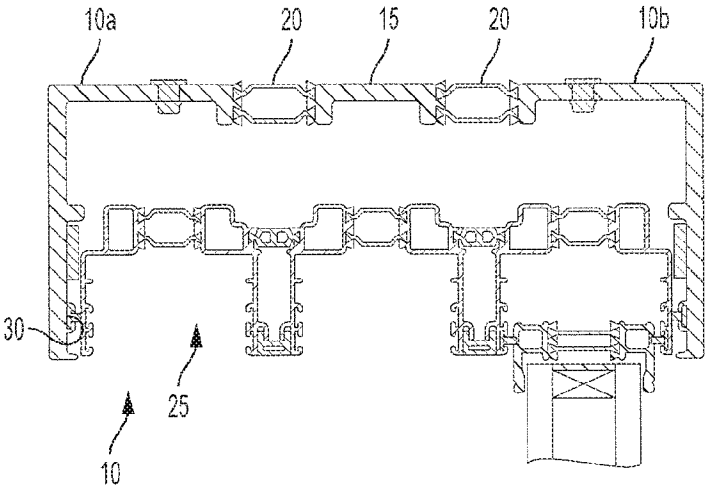

As shown in FIGS. 2 and 3, the header 10 according to an exemplary embodiment includes a left header piece 10*a* and a right header piece 10*b* with an extender provided therebetween 15. The left header piece 10*a* (e.g., a first header piece) and the right header piece 10*b* (e.g., a second header piece) are attached to either side of the extender 15 by connectors 20, such that the left header piece 10*a* and the right header piece 10*b* are mirror images of each other. It will be understood that any number of connectors 20 can be used. It will also be understood that the header 10 can be provided without the extender 15, whereby the left header piece 10*a* and the right header piece 10*b* are connected to each other by one or more connectors, as shown in FIGS. 4 and 5.

The connector 20 not only connects the left header piece 10*a*, the right header piece 10*b*, and the extender 15 together, but also provides a release of thermal energy for the header 10. That is, according to one exemplary embodiment, the connector 20 may be a thermal connector which enables thermal energy to more efficiently escape through the connector. For example, while the connector 20 can be formed of any material known in the art, the material used to form the connector 20 can have an improved thermal efficiency over the material used for the left header piece 10*a* and the right header piece 10*b*. It will be understood that the left header piece 10*a*, the right header piece 10*b*, and the extender 15 can also be formed of any material known in the art. It will also be understood that the header 10 is not limited to use for sliding doors, but can also be used for windows.

While the figures illustrate a single extender 15, the header 10 can be provided with any number of extenders 15 provided between the left header piece 10*a* and the second header piece 10*b*. The number of extenders 10 is determined according to the number of sliding panels and tracks necessary for the corresponding sliding doors or windows, as illustrated in, for example, FIGS. 4-14. While FIGS. 4-14 illustrate tracks 25 for allowing sliding doors or windows to move, it will be understood that roller tracks or other friction mitigation devices may be used to allow the sliding panels to be opened and closed, thereby minimizing the friction between the panels and the tracks 25.

Further, the header 10 can include slots or cuts to accommodate cabling (not shown), which can be used to move the sliding doors and windows.

The left header piece 10*a* and the right header piece 10*b* each include a first side and a second side. The first side and the second side are essentially perpendicular to each other. However, it will be understood that the first side and the second side can be joined so that the connection between the first side and the second side is curved or such that the angle of connection is greater than or less than ninety-degrees.

Figure 14:
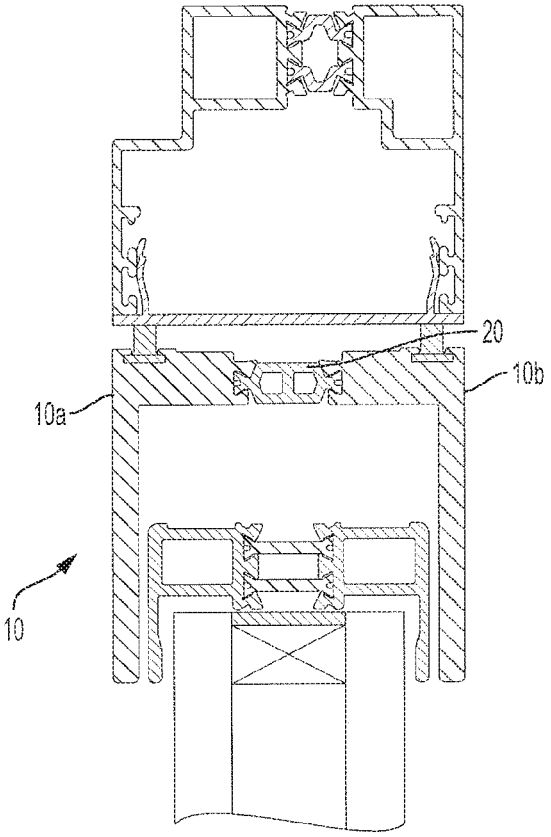

As shown in, example, FIGS. 2 and 3, the left header piece 10*a* and the right header piece 10*b* are also provided with protrusions 50 which are configured to receive or crosspiece 60. The crosspiece 60 can be a bar formed from any material known in the art. The crosspiece 60 extends parallel along one of the first side and the second side of the left header piece 10*a* and the right header piece 10*b*. It will be understood that only one of the right header piece 10*a* and the left header piece 10*b* could include the protrusion 50 and the crosspiece 60. In some embodiments, as illustrated in FIG. 14, neither the right header piece 10*a* nor the left header piece 10*b* include a protrusion 50 or a crosspiece 60. As further shown in FIGS. 2 and 3, the left header piece 10*a* and the right header piece 10*b* are provided with components 30 that are configured to contact tracks 25.

Figure 1:
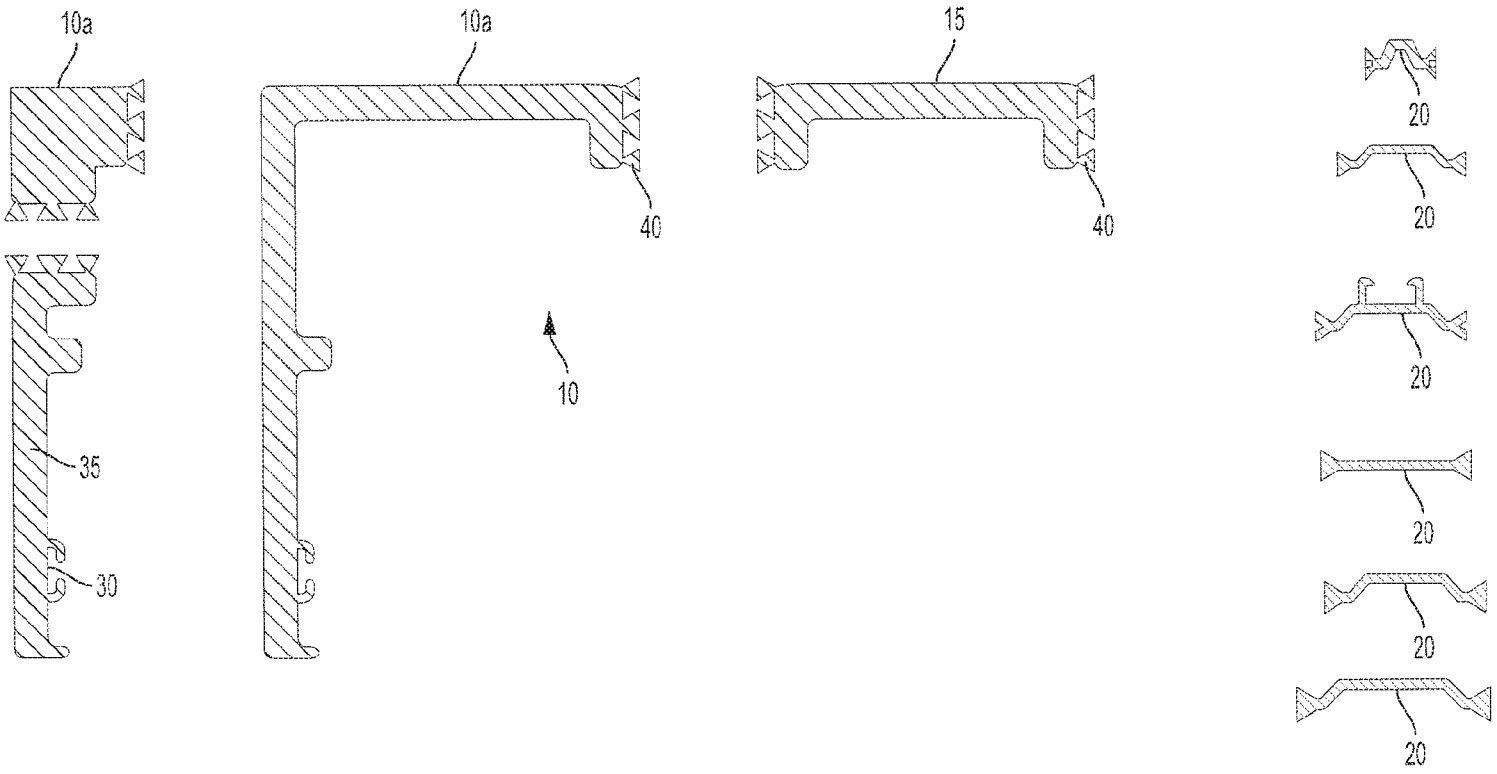
FIG. 1 illustrates an exploded view of elements of a header according to exemplary embodiments.

According to another exemplary embodiment, FIG. 1 illustrates how the left header piece 10*a* (or the right header piece 10*b*, not shown) can receive a connector 20 on at least two sides. This configuration allows not only the width of the header 10 to be extended, but also allows a user to change the height of the header 10 by including different vertical portions 35 using the connector 20 to provide different configurations.

FIG. 1 also illustrates various exemplary embodiments of the connector 20. The connector 20 can include any size, with a preference of between 12 mm and 36 mm in length. The connector 20 can have any shape, including a straight bar shape, a shape in which each end is angled from the body of the connector 20, or the connector 20 can include additional projections 20*c* to allow the connector 20 to attach to another device. As shown in FIG. 1, each end 20*a*, 20*b* of the connector 20 is flared, which allows the connector 20 to connect to the left header piece 10*a*, right header piece 10*b*, and extender 15 at connection portions 40.

According to another exemplary embodiment, brushes, gaskets, and thermal breaks (not shown) may be placed at any location along the header 10. That is, the header is intended to have multiple configurations depending on the requirements of the user.

In another exemplary embodiment as illustrated in FIG. 14, the header 10 can be used in a configuration in which a crosspiece is provided on a pivoting panel. In this configuration, the crosspiece ensures that the deflection channels compress so that the doors or windows pivot or rotate when the crosspiece is mounted on the pivoting panel. The header 10 allows for various sized crosspieces to be used, while also providing a thermal break through the connector 20 to allow heat to dissipate from device. Use of the header 10 is not limited to a pivoting panel, and may be used in any door and/or window configuration known to those of skill in the art.

While the exemplary embodiments have been particularly shown and described, it will be understood by those of ordinary skill in the art that various changes in form and details may be made therein without departing from the spirit and scope of the inventive concept as defined by the appended claims

What is claimed is:

1. A header, comprising:

a first header piece;

a second header piece, attachable to the first header piece; and an extender provided between the first header piece and the second header piece, wherein the first header piece and the second header piece are mirror images of each other and are connected by a connector, wherein the header is disposed horizontally above a window or a door, wherein a cantilevered flange of the first header piece is extended towards the second header piece, wherein, in a direction from the first header piece to the second header piece, a length of the cantilevered flange is greater than a length of the connector, wherein the first header piece and the second header piece are each substantially L-shaped, wherein the cantilevered flange is cantilevered from an upper corner of the substantially L-shaped shape of the first header piece above the window or the door, wherein the first header piece and the second header piece are coupled to a plurality of inner tracks therebetween, wherein each of the inner tracks is coupled to a respective one of a plurality of panels, wherein the header simultaneously accommodates the plurality of panels therein between the first header piece and the second header piece, wherein, in the direction from the first header piece to the second header piece, the connector does not overlap any portion of the panels, wherein the header comprises an adjustment piece extended from at least one of the inner tracks to at least one of the first header piece and the second header piece, wherein the inner tracks are configured to be deflected relative to the header and along the adjustment piece, wherein the first header piece is attached to a first side of the extender by the connector, and wherein the second header piece is attached to a second side of the extender, opposite the first side, by another connector.

2. The header of claim 1, wherein the first header piece and the second header piece each include a first side and a second side, the first side being essentially orthogonal to the second side.

3. The header of claim 2, wherein at least one of the first header piece and the second header piece includes a protrusion on at least one of the first side and the second side, the protrusion being configured to receive or support a crosspiece for deflecting top-hung tracks or floor tracks.

4. The header of claim 3, wherein the crosspiece is a bar configured to rest on the protrusion.

5. The header of claim 2, wherein at least one of the first header piece and the second header piece does not include a protrusion on either the first side or the second side.

6. The header of claim 1, wherein the first header piece and the second header piece each include at least one protrusion which is configured to receive or support the connector.

7. The header of claim 1, wherein the connector is modular.

8. The header of claim 1, wherein the header supports a window frame or a door frame.

9. The header of claim 3, wherein the header is configured to support an elastic component that is disposed in a vertical direction between the header and the crosspiece.

10. The header of claim 1, wherein the first header piece and the second header piece are connected by a plurality of connectors, including the connector, and are configured to be separable from each other by removal of the connectors.

11. A header, comprising:

a first header piece; and a second header piece, attachable to the first header piece, an extender provided between the first header piece and the second header piece, wherein the first header piece and the second header piece are mirror images of each other and are connected by a connector, wherein the header is disposed horizontally above a window or a door, wherein a portion of the first header piece is extended towards the second header piece, wherein, in a direction from the first header piece to the second header piece, a length of the portion is greater than a length of the connector, wherein the first header piece and the second header piece are each substantially L-shaped, wherein the first header piece is attached to a first side of the extender by the connector, and the second header piece is attached to a second side of the extender, opposite the first side, by another connector.

* * * * *